United States Patent [19]

Oates

[11] Patent Number: 4,748,709

[45] Date of Patent: Jun. 7, 1988

[54] CHEWABLE MOUTHBRUSH

[76] Inventor: Dennis G. Oates, 5251 Ingraham St., San Diego, Calif. 92109

[21] Appl. No.: 918,160

[22] Filed: Oct. 14, 1986

Related U.S. Application Data

[63] Continuation-in-part of Ser. No. 769,882, Aug. 27, 1985, abandoned.

[51] Int. Cl.[4] ..... B08B 1/00; A46B 9/04

[52] U.S. Cl. ..... 15/104.93; 15/167.1; 128/62 A

[58] Field of Search ..... 15/167 R, 167 A, 104.92, 15/104.93, 104.94; 128/62 A

[56] References Cited

U.S. PATENT DOCUMENTS 3,853,412 12/1974 Griffin ..... 15/104.93 X
4,328,604 5/1982 Adams ..... 15/167 R
4,346,493 8/1982 Goudsmit ..... 15/104.93

FOREIGN PATENT DOCUMENTS 2487668 2/1982 France ..... 15/104.93
2145327 3/1985 United Kingdom ..... 15/167 R

*Primary Examiner*—Peter Feldman
*Attorney, Agent, or Firm*—Ralph S. Branscomb

[57] ABSTRACT

A brush is characterized by having a central, rigid plastic core or body in the shap of a flattened cylinder with rounded ends and having imbedded in a rigid central body bristles or bristle tufts similar to the bristle tufts that are imbedded in the plastic of a tooth brush, the purpose of the brush being to clean the teeth, stimulate the gums, and freshen the breath while one chews on the brush, with it fully contained within the mouth.

1 Claim, 1 Drawing Sheet

CHEWABLE MOUTHBRUSH

This is a continuation-in-part of application Ser. No. 769,882 filed Aug. 27, 1985 for a CHEWING MOUTHBRUSH, now abandoned

BACKGROUND OF THE INVENTION

As the life span of human beings increases, the population as well as the dental profession has paid increasing attention toward techniques for preserving teeth, jawbone structure, and gums so that they will last the 75 to 90 years that is coming to characterize the life span of an individual who takes reasonably good health care of himself and is not fatally injured in an accident. Although the teeth with slip shod care would probably last for 40 years or so in most people, except for extraordinarily strong teeth acquired through heredity, without fairly consistent and meticulous care, the average set of teeth would not last nearly as long as the average person.

The original cleaning technique involved the use of a tooth brush, and soon commercial establishments were providing dentrifice compounds of various kinds, which ostensibly help clean the plaque and bacteria from the teeth. Along with the brush, different techniques for brushing have come into vogue, which in turn replace the prior technique, generally because it was alleged to have caused the receding of the gums. Current dental advice generally incorporates "dry brushing", wherein the bristles of the brush are wiggled for ten minutes along the gum line. Also, dental flossing has been highly recommended for years, but is increasingly emphasized to remove the plaque between the teeth and the gums below the gum line to avoid gum and bone recision.

Other techniques and equipment include the water jet technique, first marketed under the trademark Water-Pik. The Water-Pik was no doubt of some help, but nevertheless was restricted by the ineffectiveness of trying to force a small water stream into difficult to reach places with enough force left to do any real good.

The automatic tooth brush stimulates gums and cleans exposed surfaces well at high speed, but also erodes tooth enamel by constant use, thereby contributing substantially to one of the toughest dental problems faced by people as they age.

Additionally, when viewing all of the equipment and techniques now available, the bottom line really boils down to the reluctance on the part of busy people to take the time to execute a thorough dental hygiene program. With the most effective equipment and techniques in the world, obviously they are of no use unless they are used regularly and correctly.

Several forms of a handle-less brush, or brush ball, have been patented. These devices are for the purpose of insertion into the mouth, to be chewed, with extending bristles cleaning the surfaces of the teeth. One of these devices is disclosed in U.S. Pat. No. 3,853,412, issued to Gerald D. Griffin on Dec. 10, 1974. This device has a yielding, collapsible, hollow spherical ball in its principal embodiment with short brushes extending outwardly so that the user can chew the ball while the brush is cleaning his teeth. The hollow ball is perforated and contains dentrifice which extrudes through the perforation as the ball is chewed. While this may be somewhat effective, because the ball yields so much there is an absence of the really positive brushing action that one achieves through use of a tooth brush, and moreover, the user will wind up with a large quanity of toothpaste in his mouth, in places where there is no handy place to spit it out and rinse out his mouth.

Another patent issued to Christy F. Conder, U.S. Pat. No. 3,231,925, was issued Feb. 1, 1966, on a rubbery device like one of the jacks used to play ball and jacks. It is not really a brush, but the rubbery spike-like protusions will hopefully enter between the teeth and clean food particles from them.

Lastly, a tablet tooth brush was developed by Howard Cohen, and once was the subject of French Pat. No. 2,487,668, issued February 1982. A very small canvas strip mounts a series of short bristles which are coated with dentifrice with the bristles and central strip being contained within a soluble tablet. The bristles are not rigidly mounted, and the canvas is completely flexible so that a positive brushing action is not achieved.

There is a need for a brush ball or chewable mouth brush somewhat like those described in the above identified patents, but which provides a positive brushing action and which is shaped and dimensioned to be contained inconspicuously in the mouth and chewed like chewing gum, so that persons using the mouthbrush are not required to take time out of their daily lives to engage in an extensive, time consuming regimen of oral hygiene.

SUMMARY OF THE INVENTION

The instant invention fulfills the above stated need by providing a mouthbrush having a rigid core which mounts bristles positively, so they have a positive, non-yielding support to more effectively clean the teeth.

The core of the mouthbrush is a body in the shape of a flattened cylinder with rounded ends which mounts bristle tufts which preferably cover the entire surface, extending substantially radially outwardly from the core in all directions so that as the mouthbrush is chewed not only are the ends and sides of the teeth clean, but also the gums, the tongue and cheeks, floor of the mouth, palate, crevices between the teeth, and even bridges are all cleaned and stimulated, removing plaque increasing circulation to everything in the oral cavity. Thus, use of the mouthbrush will substantially help prevent oral diseases such as tooth decay, gum disease, cancer, tumors, bone decay and other maladies. In addition to direct stimulation and cleaning, salivation is also increased, so that the saliva will act as a natural rinse, flush and breath freshener of the mouth tissues.

In the preferred embodiment, both the core or body of the brush and the bristles are impregnated with medication and possibly dentrifice and breath freshener which slowly dissolve as the brush is chewed, further treating the teeth and other oral cavity surfaces.

DETAILED DESCRIPTION OF THE PREFERRED EMBODIMENT

Figure 1:
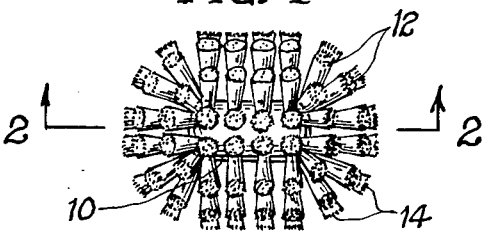
FIG. 1 is an elevation view of the mouthbrush.

As shown in the drawings, at the center of the mouthbrush is a core or body 10. This body is made out of a rigid, non-compressible and substantially non-yielding material, typically being a plastic such as polystyrene, irradiated polyethelene, polytetraflourethylene, or a polymide such as nylon. Glassy, ceramic, or metal materials could also be used.

Figure 2:
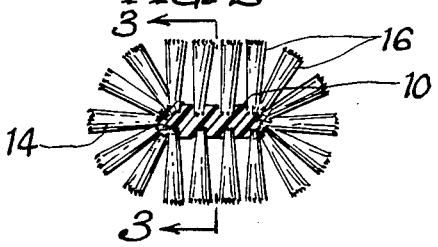
FIG. 2 is a section taken along line 2—2 of FIG. 1.
Figure 3:
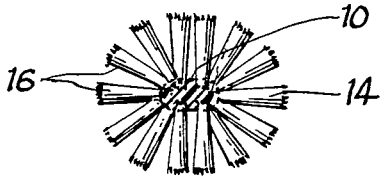
FIG. 3 is a section taken along line 3—3 of FIG. 2.

As can be seen by consecutive observaton of FIGS. 1 through 3, the body, which is approximately double life size in every dimension in the drawings, is in the shape of a cylinder that has been flattened in one dimension, and has rounded ends 12. The size of the illustrate embodiment is ten millimeters long (half the actual size of the drawings), two and one half millimeters thick and five millimeters wide. These dimensions are selected as an average dimension for purposes of the drawings, but the body could vary from ten millimeters to twenty millimeters long, from two to five millimeters thick, and from five to ten millimeters wide. The body is thus substantially in the shape of an elongated tablet similar to the shape in which vitamin pills are often made.

As illustrated in FIGS. 1 through 3, in the preferred embodiment the bristles 14 are provided in tufts 16 which are imbedded into the body such that a somewhat conical shape is defined by each tuft. At the base of the tufts, they are separated from one another by about one millimeter (two millimeters in the actual drawings), and could vary in spacing from half a millimeter to three millimeters. The cone shape provides for a very positive mounting at the base or body 10 which permitting the bristles to flair outwardly to define a more extensive surface with their tips. The bristles themselves may vary in length from two millimeters to eleven millimeters, and are shown in the drawings as extending about five millimeters (doubled to ten in the drawings) from the rigid body. In other words, the bristles as actually illustrated are about as long as they would ever be, and modifications using considerably shorter bristles are to be considered and would be incorporated within the scope of this disclosure and within the spirit of the claims. Smaller brushes with shorter bristles would of course be appropriate for children.

The bristles may be made of an organic plastic, similar to the material that the body is made from, that is, polystyrene, irradiated polyethylne, polytetraflourethylene, etc. They would essentially be made of the same materials, and imbedded in the body in the same way, as the bristles of conventional toothbrushes.

Thus, FIGS. 1 through 3 illustrate the principal embodiment of an invention which effectively stimulates and cleans gums, teeth, the insides of the cheeks, the tongue, and the floor and roof of the mouth. Plaque is removed from all of the surfaces, and saliva is stimulated to flow to cleanse the mouth and wash away the plaque removed by the brushing action of the mouthbrush.

Figure 4:
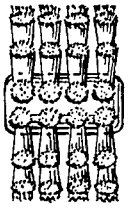
FIG. 4 is an alternative embodiment of the embodiment of FIGS. 2 and 3 in which the bristles are omitted from the ends of the body, and the body ends are flattened somewhat but is otherwise the same; and, FIG. 5 is another embodiment in which the bristles are mounted in the core such that a uniform surface is defined at the bristle tips rather than discreet bunches or tufts being visible.

Certain modifications have been illustrated in the remaining figures, FIG. 4 illustrating a brush in which the ends of the body 10 do not mount any bristles, so that a cylindrical shape is achieved for the sake of uniformity, the bristles in FIG. 4 having been illustrated as being of the same length as the bristles in FIG. 1, and again it would be quite possible to make them much shorter, or at an intermediate length. In the illustration in FIG. 4, the rounded ends have been flattened somewhat so that they do not protrude, as the purpose of the device is of course to brush, and not to rub with plastic.

Figure 5:
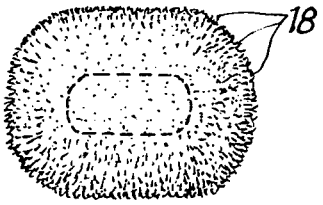

FIG. 5 illustrates a slight modification which the bristles are imbedded in the body such that the outer surface 18 defined by the tips of the bristles are substantially continuous and uninterrupted, as opposed to the discreet bristle tufts illustrated in FIGS. 1 through 4. This would be achieved by having a greater flair to the bristle tuft, or having tufts with fewer bristles and placed closer together, etc. The continuous surface illustrated in FIG. 15 would tend to prevent the teeth from slipping between bristle tufts and ensure that the exposed ends of the teeth as well as the sides would be brushed.

It is preferred that the bristles, as well as preferably the body, of the mouthbrush be impregnated with a medicated solution. As an example, brushes with their bristles in place could be presoaked in a solution of water, alcohol, glycerin chloride, zinc, sodium and polysorbate. There are hundreds of other medications which could be incorporated in the impregnating solution, with the above being the only example. Once the impregnation has been achieved, the individual mouthbrush should be sealed in a polyethylene bag or otherwise packaged to retain the medication in place and maintain sterility of the mouthbrush. Incorporated with the medication could be a breath freshener, a nutrional aid in the form, for example, of minerals that are required in very small traces, or some other therapeutic pharmaceutical substance which is beneficially used in the oral cavity.

The mouthbrush could be made of high quality to be used quite a number of times, or it could be made so that it will maintain complete effectiveness for at least one use, but be cheap enough so it could be chewed and disposed of after a single use. This would make it attractive to someone on the move, who may want to chew the mouthbrush en route to an appointment, etc., and then throw it away, without having to deal with a saliva coated brush and perhaps not having the time or inclination to go into a public restroom to rinse it off, shake it dry and return it to its package.

In any of its forms, the mouth brush provides a vehicle for cleaning the teeth while doing the daily chores or work routine, without requiring any time to be set aside for the oral hygiene program. Some people will find the mouthbrush enjoyable, and for anybody with a reasonably healthy mouth the brush will be effective and elevating the level of oral hygiene cleaning the teeth and other surfaces of the oral cavity while dispensing the medication, breath freshener, and possibly trace mineral nutrients for the benefit of the user. The net effect of utilization of the mouthbrush is the maximization of efficiency by providing a high level of contribution to oral hygiene with an absolute minimum time consumption requirement.

I claim:

1. A mouthbrush comprising:

(a) an elongated non-compressible solid rigid body comprising a flattened cylinder having substantially parallel flattened upper and lower walls, and having substantially flattened ends free of bristles;

(b) a multiplicity of bristles imbedded in said body and extending generally radially outwardly therefrom and substantially covering the entire surface thereof except for said substantially flattened ends, the outer tips of the bristles of the upwardly and downardly extending bristles defining flattened surfaces coinciding in shape with the parallel upper and lower flattened walls of said flattened cylinder;

(c) said body and bristles being dimensioned to fit within the mouth of a user, the vertical depth of the rigid body being about ¼ of its length thereof and the horizontal width of the rigid body being about ½ of the length of said rigid body; and, (d) said bristles being impregnated with a saliva-soluble medicated substance which dissolves in the saliva and is swallowed naturally by the user as he swallows his saliva;

whereby said rigid body, because it is not resilient or collapsible, forces said bristles into the occlusal surfaces of the teeth and causes the bristles to effectively stimulate the gums while said medicated substance treats the teeth and the gums until it is swallowed in the saliva.

* * * * *